United States Patent [19]

Nowak et al.

[11] Patent Number: 4,585,250

[45] Date of Patent: Apr. 29, 1986

[54] RELEASE SKI BINDING

[75] Inventors: Gerhard Nowak, Biedermannsdorf; Alfred Winter; Hans P. Morbitzer, both of Vienna; Klaus Kruschik, Gumpoldskirchen; Robert Taucher, Podersdorf, all of Austria

[73] Assignee: TMC Corporation, Walterswil, Switzerland

[21] Appl. No.: 561,714

[22] Filed: Dec. 15, 1983

[30] Foreign Application Priority Data

Dec. 16, 1982 [AT] Austria ..... 4569/82

[51] Int. Cl.[4] ..... A63C 9/081; A63C 9/085

[52] U.S. Cl. ..... 280/618; 280/624; 280/625; 280/628

[58] Field of Search ..... 280/613, 616, 617, 618, 280/624, 625, 628, 634, 629, 630

[56] References Cited

U.S. PATENT DOCUMENTS

| | | | |
|---|---|---|---|
| 3,910,591 | 10/1975 | Saloman | 280/613 |
| 4,145,071 | 3/1979 | Saloman | 280/624 |
| 4,177,584 | 12/1979 | Beyl | 280/613 |
| 4,266,806 | 5/1981 | Weigl | 280/618 |
| 4,394,032 | 7/1983 | Storandt | 280/624 |

FOREIGN PATENT DOCUMENTS

| | | |
|---|---|---|
| 2324078 | 11/1974 | Fed. Rep. of Germany . |
| 2401729 | 7/1975 | Fed. Rep. of Germany . |
| 2649826 | 6/1977 | Fed. Rep. of Germany . |
| 3026918 | 7/1980 | Fed. Rep. of Germany . |

*Primary Examiner*—John J. Love
*Assistant Examiner*—Joseph G. McCarthy
*Attorney, Agent, or Firm*—Flynn, Thiel, Boutell & Tanis

[57] ABSTRACT

A release ski binding having a sole plate which is pivotal in its central region about a generally vertical axis and can be forwardly pivoted about a transverse axle which is arranged in front of the vertical axle, which sole plate is held in the skiing position by a resilient holding mechanism which, during a release, effects an opening of the elements which hold the ski shoe to the ski.

In order to create a simple and reliable construction of the binding, a stepping bar, which is under the influence of an erecting spring, is supported on the sole plate, which stepping bar during a stepping down procedure, moves the elements into the ski boot clamping position.

13 Claims, 5 Drawing Figures

RELEASE SKI BINDING

FIELD OF THE INVENTION

The invention relates to a release ski binding comprising a sole plate which is pivotal in its central region about a generally vertically upright axis and can be forwardly pivoted about a transverse axle which is arranged in front of the vertical axle, which sole plate is held on the ski in the skiing position by a resilient holding mechanism, which holding mechanism effects, in response to a swivelling movement of the sole plate relative to the ski through a predetermined angle of traverse both upwardly and also sidewardly, the opening of a locking mechanism.

BACKGROUND OF THE INVENTION

Such release ski bindings are described in German Pat. No. 25 33 337. In these conventional ski bindings, the spring of the holding mechanism acts through a piston on a generally mushroom-shaped follower member which is swingably supported to all sides in the housing of the holding mechanism. The stem part of the mushroom-shaped follower member is received in a recess of a ski-fixed fitting. In these conventional ski bindings, the ski shoe is held at its tip by means of a rigid bar on the sole plate. In the case of a fall of the skier rearwardly, the ski shoe, therefore, is released only with great difficulty.

This disadvantage is avoided in the ski binding according to German Pat. No. 23 24 078; however, this binding is very complicated in its design, whereby the release mechanism is stored in the space between the base plate and the sole plate. This, however, requires special sealing measures to prevent the penetration of snow and dirt. Furthermore, mounting of this device is complicated and expensive.

The goal of the invention is to overcome the mentioned disadvantages of the conventional designs and to provide a release ski binding of the abovementioned type, which is simple in its design and inexpensive to manufacture and which opens also during rearward falls of the skier.

This goal is inventively attained primarily by the locking mechanism having holding elements in the form of two laterally spaced jaw pairs or of one laterally spaced jaw pair and one heel down-holding means, which holding elements are movable into the clamping position by a stepping bar which is supported on the sole plate and which is under the influence of an erecting spring.

A number of possibilities are offered for the concrete structural development of the inventive release ski binding. Thus, one inventive embodiment is distinguished primarily by the stepping bar being swingably supported in a housing on the sole plate and being coupled with a slide plate which is guided on the sole plate, which slide plate has four wedge-shaped shoulders engageable with the jaws for the purpose of moving same to the locking position. A hinge plate is provided for coupling the stepping bar with the slide plate, one end of which hinge plate is swingably supported on the slide plate and the other end is slidingly guided by means of a transversely extending bolt, the ends of which are received in a slotted hole of the stepping bar and on a cam surface arranged on the sole plate.

A further exemplary embodiment is inventively distinguished from the prior art by the stepping bar being supported through a hinge plate on a slide plate which is guided on the sole plate and which carries at its front end control elements, which are constructed as chucking wedges, for effecting an erecting of the two jaws and, in the rear region thereof, is connected to a two-arm lever for moving the heel down-holding means mounted on an articulated parallelogram. In a modification of this exemplary embodiment, the slide plate is replaced with a slide ring, and the jaws are not swung into the clamping position by wedges, but by a pressing rod and by pulling rods which are hinged to the slide ring. In both embodiments, it is possible to hinge the two-arm lever on a piston guided in a spring housing and is loaded on both sides by pressure springs. Further, the heel down-holding means can be held during the stepping-in operation by a locking lever, however, can be released at the end of the stepping-in operation. In this instance, the one pressure spring is supported on a piston which is secured to the slide plate or on the pressure rod. Furthermore, it is possible for the heel down-holding means to carry a locking nose, which is associated with the locking groove of a swingably supported stepping plate constructed as a locking lever.

These measures have the advantage that the heel of the ski boot is clamped in place only when it rests on the sole plate. An incorrectly skewed clamping of the ski shoe is therefore practically impossible.

In these embodiments, it is furthermore provided that the rod of the piston extends through the spring housing, and is supported on a portion of the holding mechanism. Further, the part of the slide plate or rather of the pressing rod, which part is extended beyond the spring housing, carries a hook, into which engages a locking pawl in the locked position of the slide plate, which locking pawl is loaded by a spring. In this manner, the movement of the jaw into the open position is started reliably by the holding mechanism.

BRIEF DESCRIPTION OF THE DRAWINGS

Exemplary embodiments of inventive ski bindings are illustrated in the drawings, in which.

DETAILED DESCRIPTION

Figure 1:
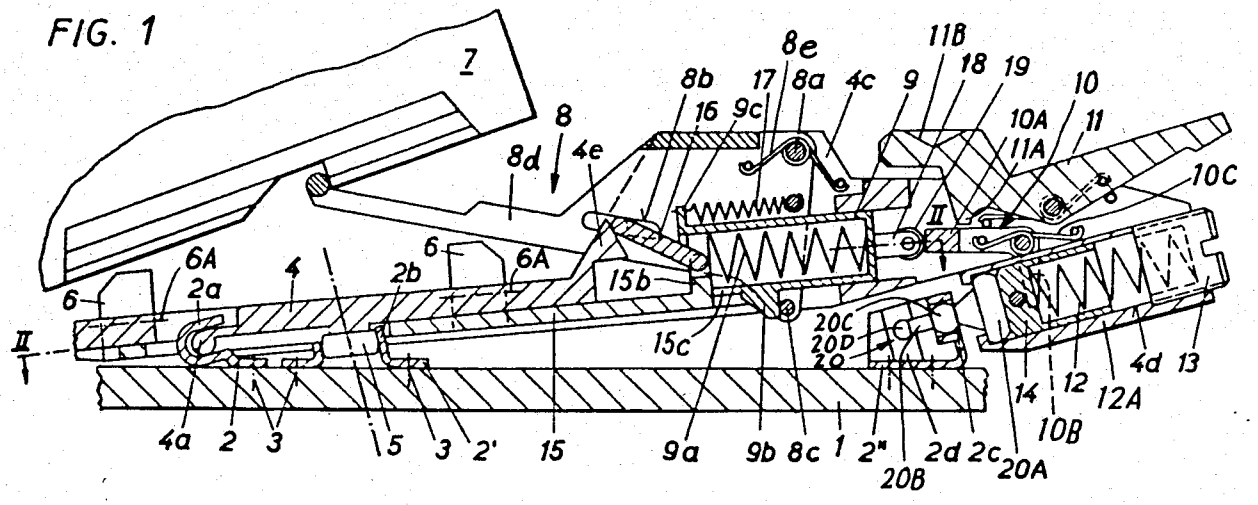
FIG. 1 is a cross-sectional view taken along the line I—I of FIG. 2 and wherein the binding is in the stepping-in position.
Figure 2:
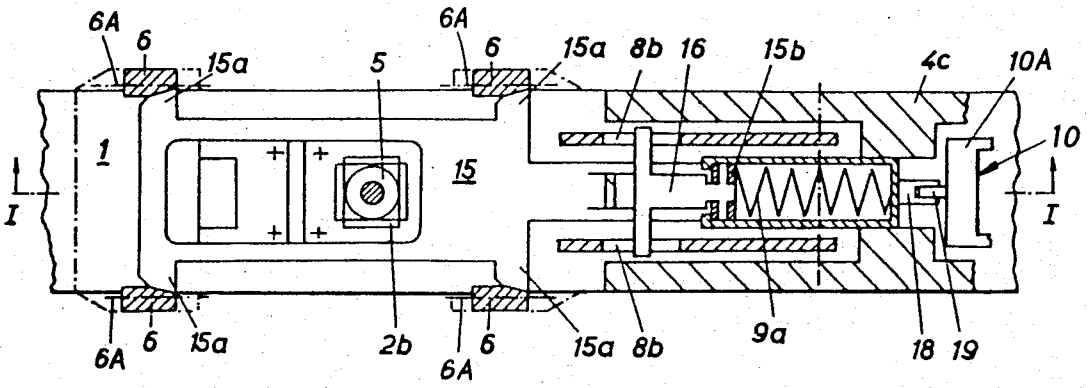
FIG. 2 is a cross-sectional view taken along the line II—II of FIG. 1.

In a first exemplary embodiment according to FIGS. 1 and 2, fittings 2, 2' and 2'' are secured to the upper surface of a ski, for example, by means of screws schematically illustrated as at 3. The frontmost fitting 2 has a U-shaped bent section 2*a* and the middle fitting 2' has a guideway 2*b*. The rearmost fitting 2'' has two guide slots 2*c*, 2*d*, namely one horizontally extending slot 2*c* and one vertically extending slot 2*d*.

Above the fittings 2, 2', 2'' there is arranged a sole plate 4. The sole plate 4 has a projection thereon with a transverse shaft 4*a* which is received in the bent section 2*a*. The sole plate 4 also has a downwardly projecting pin 5 with a spherical circumferential surface which is guided in the guideway 2*b*. The sole plate 4 also has on its two longitudinal sides four pivotally supported jaws 6, each of which are constructed as two-arm levers and are designated to hold the ski shoe 7 from the two sides. German Offenlegungsschrift No. 24 01 729 (see especially FIG. 3) does show such a pivotal arrangement of a jaw. The pivot axes therefor are schematically shown in FIGS. 1 and 2 as at 6A. The jaws 6 are under the influence of springs, not illustrated, which urge the jaws into the open position. The rear end of the sole plate 4 has a housing 4*c*, in which is pivotally supported a stepping bar 8 on a transversely extending axle 8*a*. A spring housing 9 having a spring 9*a* therein is movably guided in the longitudinal direction of the sole plate in the housing 4*c*. Furthermore, a two-arm lever 10 and a release lever 11 are each pivotally supported in the housing 4*c*. In addition, a housing member 12A having a helical pressure spring 12 in a bore 4*d* therein is mounted on the housing 4*c*. The initial tension of the pressure spring 12 is adjustable by means of an adjusting screw 13 in the end of the housing member 12A. One end of the spring 12 abuts the adjusting screw 13 while the other end of the spring 12 rests on a piston 14 movably guided in the bore 4*d*. Finally, the housing 4*c* supports yet a cam 4*e* which is approximately triangular in cross section and extends transversely of the longitudinal axis of the ski.

A slide plate 15 is movably guided in the longitudinal direction of the ski on the underside of the sole plate. The plate 15 has a pair of slightly wedge-shaped lateral shoulders 15*a*, each of which engages the lower ends of the jaws 6. Furthermore, the slide plate 15 has an upwardly projecting shoulder 15*b* which extends into the spring housing 9 through a slot 15*c*. One end of the spring 9*a* housed within the spring housing 9 engages the shoulder 15*b*.

The stepping bar 8 has a pair of laterally spaced slotted holes 8*b* therein, in which one end of a hinge plate 16 is movably and swingably arranged. The other end of the hinge plate 16 is hingedly connected to the shoulder 15*b* of the slide plate 15. Furthermore, a stop bolt 8*c* is secured to the stepping bar 8. A nose 9*b* on the spring housing 9 engages the stop bolt 8*c*. The spring housing 9 has a projection 9*c* thereon, on which one end of a tension spring 17 is anchored. The other end of the spring 17 is secured to a lug on the stepping bar 8. The rear end part of the spring housing 9 has a bearing 18 rotatably supporting a roller 19. The frontwardmost arm 10A of the two-arm lever 10 is supported, in the skiing position of the ski binding, on the roller 19. The other arm 10B of the lever 10, however, engages the laterally extending ends of a pin 14A on the piston 14. The release lever 11 has a shoulder 11A thereon, which during pressing down of the release lever, comes to rest on the upper side surface of the arm 10A of the lever 10 and moves the arm 10A downward away from engagement with the roller 19.

A follower member 20 is supported in the rear end of the sole plate 4. The member 20 has an approximately mushroom-shaped design having an enlarged head 20A and stem 20B. Two spherical enlargements 20C and 20D are arranged on the stem 20B. One of the enlargements 20C is guidingly received in the horizontal guide slot 2*c*, while the other enlargement 20D is provided at the terminal end of the stem 20B, however, is guidingly received in the vertical guide slot 2*d*. The head 20A of the follower member 20 has a flat rearwardly facing surface which engages the frontward side of the piston 14.

OPERATION

The ski binding operates as follows: During stepping in, the ski shoe 7 is first placed above or through a longitudinal sliding movement on the stepping bar 8 so that, particularly, the bottom flat side surface of the heel engages the stepping bar 8. The stepping bar 8 is thereafter stepped down upon by the ski shoe. The slide plate 15 is thereby moved to the right against the force of the spring 9*a* through the action of the hinge plate 16, which with its left end slides downwardly and rearwardly along the upper portion of the cam 4*e* to cause the top part of the jaws 6 to pivot outwardly to the open position under the influence of torsion springs which are not illustrated in the drawings. The ski shoe 7 can now be guided between the opened jaws 6. The tension spring 17 is simultaneously tensioned by the pivotal movement of the stepping bar 8. When the stepping bar 8 reaches the lower position of travel, the left end of the hinge plate 16 slides under the lower portion of the cam 4*e* to cause the plate 15 to be moved to the left by the spring 9*a*. A movement of the slide plate 15 to the left will cause the top part of the jaws 6 to be pivoted inwardly to engage the ski shoe 7. Due to a shoulder 8*d* on the stepping bar 8, which shoulder is provided below the heel of the ski shoe 7, the cross part of the stepping bar on which rests the flat side surface of the heel during stepping in, is, in the skiing position, lower than the lower boundary plane of the ski shoe 7.

If the loads which act onto the ski shoe 7 lie in the elastic range of the ski binding, then the sole plate is pivoted about the axis of the transverse axle 4*a* caused by a moment in a vertical plane. As a result, the pin 5 moves upwardly or downwardly within the guideway 2*b*. However, during a moment in a horizontal plane, the sole plate 4 is pivoted about the axis of the pin 5 to cause the transverse axle 4*a* to slide to one side in the bent section 2*a*.

If, however, during a frontal fall or during a twisting fall, the elastic region of the ski binding is exceeded, and the follower member 20 is pivoted with respect to the axis of the bore 4*d* of the housing member 12A, the head 20A of the follower member 20 presses the piston 14 back against the force of the pressure spring 12. However, this movement of the piston 14 effects a pivoting of the two-arm lever 10 in a counterclockwise direction, to cause the arm 10A to slide off from the roller 19. However, this has the result that the spring housing 9 is pulled back to the right by the tension spring 17 and—since it is coupled with the plate 15 through the shoulder 15*b* thereon—moves the plate 15 also to the right to effect a release of the ski shoe 7 as aforesaid. Through the rearward movement of the spring housing 9, however, the hinge plate 16 is guided along the underside of the cam 4*e* until it becomes disengaged therefrom. As soon as the ski shoe 7 has left the jaws 6, the stepping bar 8 is pivoted upwardly in a clockwise direction about the axis of the axle 8*a* under the influence of a torsion erecting spring 8*e*. The left end of the hinge plate 16 received in the slotted holes 8*b* moves with the stepping bar 8 and slidingly engages the rightwardly facing boundary surface of the cam 4*e* shown in FIG. 1. The spring housing 9 is at the same time moved forwardly through the connection of the nose 9*b* with stop bolt 8*c* against the urging of the tension spring 17 so that the two-arm lever 10 can return clockwise into its normal position under the urging of a torsion spring 10C.

Therefore, the ski binding is ready for a renewed stepping in.

If a voluntary release is to be initiated, the release lever 11 is swung counterclockwise by placing the tip of the ski pole in a socket 11B provided therefor. This causes the shoulder 11A to move the arm 10A of the two-arm lever 10 out of engagement with the roller 19, which results in an opening of the binding as aforesaid. The function of the individual elements of the binding thusly corresponds with the function performed during an automatic release.

ALTERNATE CONSTRUCTION (FIGS. 3 AND 4)

Figure 3:
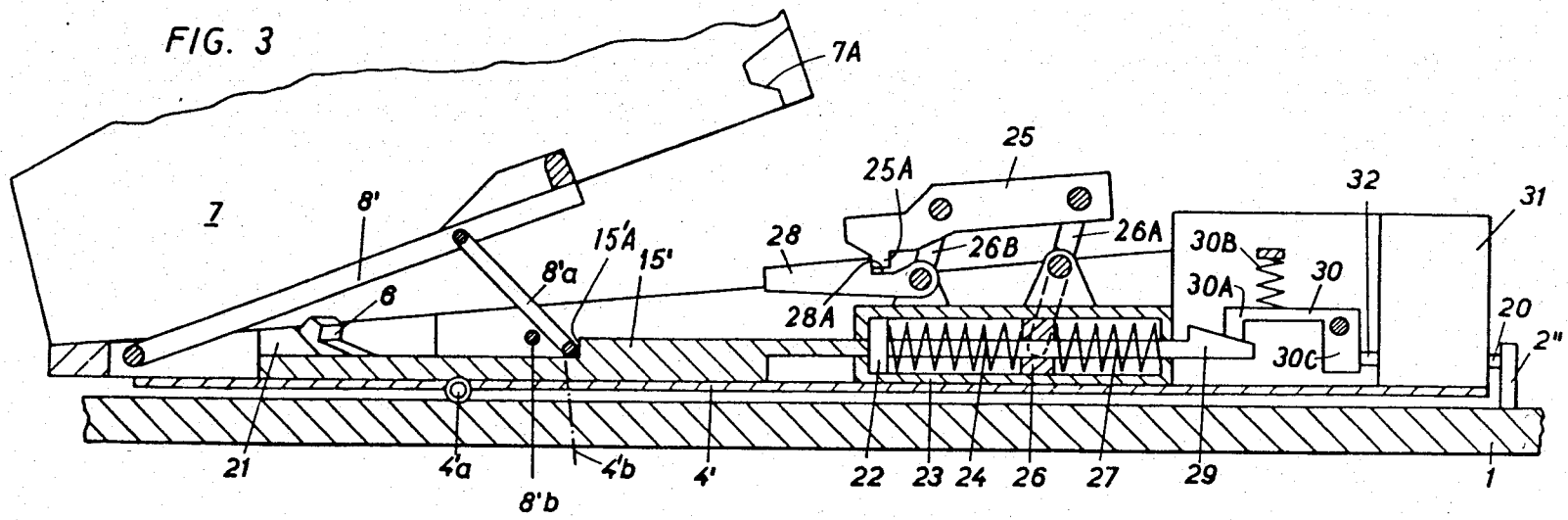
FIG. 3 is a cross-sectional view taken along the line III—III of FIG. 4 and of a further embodiment.
Figure 4:
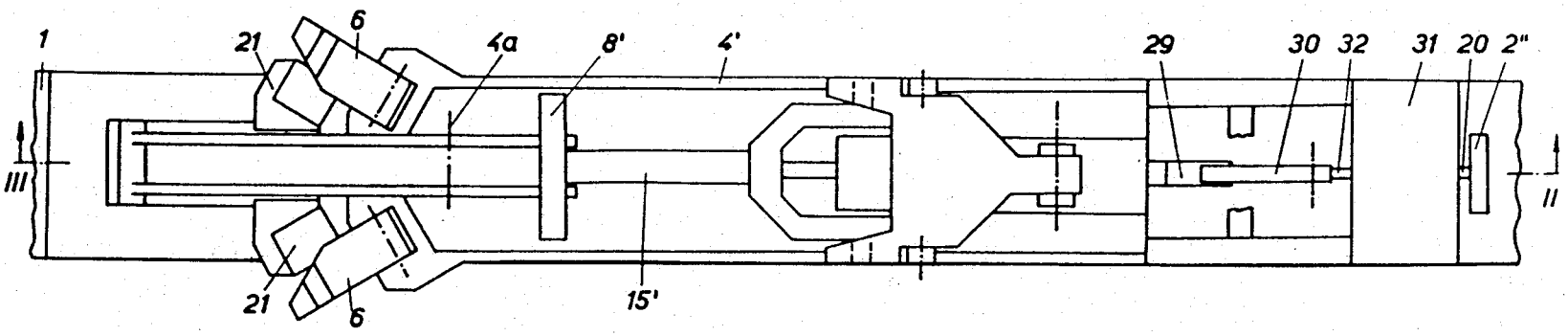
FIG. 4 is a top view of FIG. 3.

FIGS. 3 and 4 illustrate a further embodiment of an inventive ski binding. The sole plate 4' is pivotally mounted for movement about the axis of a transverse axle 4'a and about the axis of a vertical axle 4'b, both of which are only schematically indicated. A stepping bar 8' is hingedly connected to the front end of the sole plate 4'. The stepping bar 8' is hingedly connected through a hinge plate 8'a to a slide plate 15', which plate is movably guided in the longitudinal direction of the ski on the upper side of the sole plate 4'. Two jaws 6 are pivotally supported on axes which lie in a horizontal plane, however, define an acute angle with respect to the vertical longitudinal center plane of the ski. The two jaws 6 are under the influence of springs, not illustrated, which urge the jaws outwardly into the open position. Also the stepping bar 8' is urged to the position shown in FIG. 3 by an erecting spring, which is not illustrated.

Two wedge-shaped projections 21 on the upper side of the slide plate 15' engage the back sides of the two jaws 6. These projections 21 pivot the two jaws 6 against the action of the springs into the clamping position, as soon as the slide plate 15' is pulled toward the tail end of the ski. A piston 22 is fixedly connected to the end of the slide plate 15', which piston is movably guided in a spring housing 23 and is loaded on a side thereof remote from the slide plate 15' by a pressure spring 24. A heel down-holding means 25 is provided above the spring housing 23, which down-holding means is connected to the spring housing through a control structure 26A and 26B, which together with the parts 23 and 25 form a hinged parallelogram. The two laterally spaced control structures 26A are two arm levers which are adjacent to the end of the down-holding means 25 extend downwardly through a hinge axle and are hinged to a piston 26 by means of pins received in slotted holes, which piston is guided freely movably in the spring housing 23 and is engaged on one side thereof by the pressure spring 24 and on the other side by a further pressure spring 27 to urge the piston 26 to its center position. Below the heel down-holding means 25, a stepping spur 28 is hingedly connected to the spring housing 23, which, in the stepping-in position of the ski binding, is engaged with the heel down-holding means 25 through a groove or notch 28A and a projection 25A received in the groove. Upon a stepping down on the stepping spur 28 with the ski shoe 7, the aforesaid engagement, however, is released.

The slide plate 15' extends in the form of a piston rod through the spring housing 23 and has a hook 29 at its rear end which projects rearwardly from the spring housing. The hook 29 cooperates with a two-arm locking lever 30, one arm 30A of which is loaded by a spring 30B. A holding mechanism 31, which is similar to the one illustrated in FIGS. 1 and 2, is provided behind the lever 30. The holding mechanism 31 cooperates through a follower member 20 with a ski-fixed fitting 2'' and has a push rod 32 on the side which is remote from the follower member. The push rod is guided in the housing of the holding mechanism 31 and rests on an arm 30C of the locking lever 30.

During a stepping-in operation, the lower tip of the ski shoe 7 is guided along the stepping bar 8' until the heel of the ski shoe also rests thereon. The stepping bar 8' is subsequently stepped down upon by the ski shoe. The plate 15' is thereby moved to the right in FIGS. 3 and 4 by action of the hinge plate 8'a, until the plate 15' is held by means of an interlocking engagement of the hook 29 and the locking lever 30. The hinge plate 8'a is subsequently uncoupled from the plate 15' by the stop 8'b causing the hinge plate 8'a to be fulcrumed out of the notch 15'A. The pressure spring 24 is strongly compressed by the piston 22 in this position. The jaws 6 are, due to the rearward movement of the plate 15', already in the erected position, wherein they effect a holding of the front end of the ski shoe 7. Shortly before reaching the terminal inserted position of the ski shoe 7, the stepping spur 28 is pressed downwardly by the heel of the ski shoe. Through this the engagement of the spur 28 with the heel down-holding means 25 is released. Thus, the heel down-holding means is now urged frontwardly by the pressure spring 24 into the locking groove 7A on the ski shoe 7.

If a voluntary release is to occur, the locking lever 30 is first pivoted in the clockwise direction with the aid of a hand lever which is not illustrated and is, in this manner, lifted out from in front of the hook 29. The spring 24 now urges the piston 22 and the plate 15' to the left, which results in an opening of the jaws 6. However, the piston 26 returns forwardly to its centered position under the influence of the pressure spring 27 and through the relaxing of the spring 24. This has the result that the heel down-holding means 25, due to the action of the pivotal lever 26A, is pulled back away from the ski shoe 7. The ski shoe 7 can now be lifted off from the binding in an unhindered manner.

In the case of an automatic release, the follower member 20, which engages the ski-fixed fitting 2'', operates the holding mechanism 31, which moves the push rod 32 toward the tip of the ski until the locking lever is lifted out from in front of the hook 29. However, as has already been described in detail in the case of the voluntary release, the two jaws 6 and the heel down-holding means 25 are released.

Figure 4A:
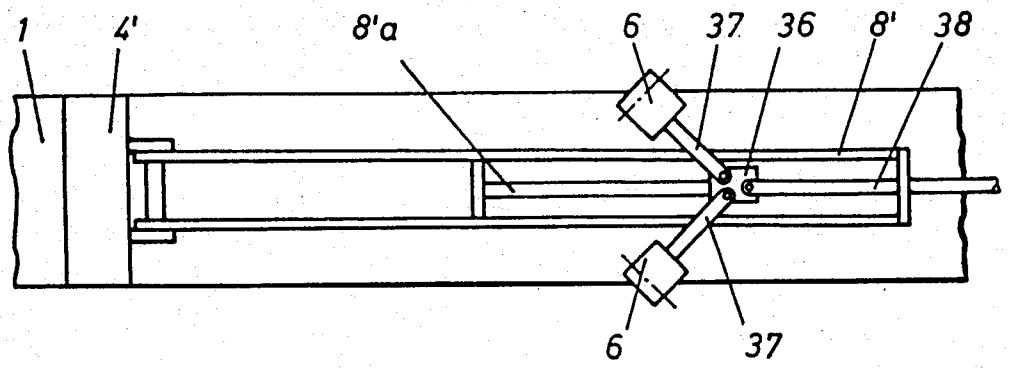
FIG. 4*a* illustrates an exemplary embodiment which is slightly modified compared with FIGS. 3 and 4.

The modification according to FIG. 4a differs from the exemplary embodiment according to FIGS. 3 and 4 in that the stepping bar 8' is not connected through the hinge plate 8'a to a plate but is, instead, connected to a slide ring 36, which is movably guided in the longitudinal direction of the ski on the sole plate 4'. One end of each of two push rods 37 is hingedly connected to the slide ring 36. The other end of each push rod 37 is hingedly connected to the jaws 6. A pressure rod 38 is hingedly connected to the slide ring 36, which pressure rod is rigidly connected to the aforesaid piston 22. The remaining construction of this modification corresponds with the exemplary embodiment according to FIGS. 3 and 4.

Of course, the invention is not to be limited to the exemplary embodiments which are described above and are illustrated in the drawings. Rather, various modifications of the same are contemplated without departing from the scope of the invention. For example, it would also be possible to equip ski bindings having only two jaws and a heel down-holding means composed of cable lines.

The embodiments of the invention in which an exclusive property or privilege is claimed are defined as follows:

1. In a release ski binding comprising a sole plate which, in its central region, is pivotal about a generally vertically upright axis and which can be forwardly rotated about a transverse axle which is arranged forwardly of said vertically upright axis, which sole plate is held on the ski in the skiing position by a resilient holding mechanism which effects, in response to said sole plate being swivelled relative to the ski to a predetermined angle of traverse both upwardly and also sidewardly, the opening of a locking mechanism, the improvement comprising wherein said locking mechanism has holding means in the form of at least one of (1) two lateral jaw pairs each adapted to engage the laterally facing sides of a ski boot; and (2) one lateral jaw pair each adapted to engage the laterally facing sides of a ski boot and one heel down-holding mechanism for holding a ski shoe onto said sole plate, wherein a stepping bar is provided and pivot means for pivotally supporting said stepping bar on said sole plate for movement between an upright erected position and a retracted position, wherein an erecting spring is provided for continually urging said stepping bar to said erected position, said holding means being movable between a ski boot holding position and a ski boot releasing position, said holding means being movable into said ski boot holding position in response to force applied to said stepping bar to effect a movement of said stepping bar to said retracted position against the urging of said erecting spring.

2. The ski binding according to claim 1, wherein said pivot means pivotally supports said stepping bar in a housing on said sole plate and is coupled to a slide plate which is guided on said sole plate, which slide plate has four wedge-shaped attachments for effecting a locking of said jaw pairs in response to a movement of said slide plate in a direction parallel to the longitudinal axis of the ski.

3. The ski binding according to claim 2, wherein an elongated hinge plate is provided for coupling said stepping bar with said slide plate, one end of said hinge plate being swingably supported on said slide plate and the other end being guided in a longitudinally extending slotted hole in said stepping bar and simultaneously engaging a cam surface arranged on said sole plate and which is approximately triangularly-shaped in a view perpendicular to a longitudinal axis of said ski.

4. The ski binding according to claim 1, wherein said holding means includes a slide plate movably guided on said sole plate through a hinge plate interposed between said stepping bar and said slide plate, said slide plate having at one end thereof control elements for moving one jaw pair to said ski boot holding position, said control elements being in the form of wedge shaped members, said slide plate having its other end connected to a two-arm lever for effecting a moving of said heel down-holding means supported on a hinged parallelogram to said ski boot holding position in response to a movement of said slide plate and said two arm lever.

5. The ski binding according to claim 1, wherein said holding means includes a slide ring movably guided on said sole plate in response to said stepping bar being stepped down upon and pulling rods hingedly connecting said slide ring to at least one jaw pair so that, during a stepping down on said stepping bar, said heel down-holding means is moved to said ski boot holding position.

6. The ski binding according to claim 4, wherein said holding means includes a spring housing and a piston reciprocally movable therein and spring means on both sides of said piston, wherein said two-arm lever is hingedly connected to said piston, and wherein said heel down-holding means, during the stepping-in operation, is held in said ski boot releasing position by a stepping spur, said stepping spur being released at the end of the stepping-in operation so that a one of said pressure springs urges said piston and said slide plate for movement to effect said holding means to move to said ski boot holding position.

7. The ski binding according to claim 6, wherein a stepping spur is provided having a locking groove therein and wherein said heel down-holding means has a locking nose thereon supported for movement into said locking groove to lock said heel down-holding means in said ski boot releasing position, said lock being released when said stepping spur is stepped down upon.

8. The ski binding according to claim 6, wherein said piston and said slide plate are connected by a rod which extends through said spring housing with its end remote from said slide plate being supported on a portion of a release mechanism.

9. The ski binding according to claim 8, wherein said remote end of said rod has a hook thereon, said hook engaging a spring loaded locking lever.

10. The ski binding according to claim 5, wherein said holding means includes a spring housing and a piston reciprocally movable therein and spring means on both sides of said piston, wherein said two-arm lever is hingedly connected to said piston, and wherein said heel down-holding means, during the stepping-in operation, is held in said ski boot releasing position by a stepping spur, said stepping spur being released at the end of the stepping-in operation so that a one of said pressure springs urges said piston and said slide plate for movement to effect said holding means to move to said ski boot holding position.

11. The ski binding according to claim 10, wherein a stepping spur is provided having a locking groove therein and wherein said heel down-holding means has a locking nose thereon supported for movement into said locking groove to lock said heel down-holding means in said ski boot releasing position, said lock being released when said stepping spur is stepped down upon.

12. The ski binding according to claim 10, wherein said piston and said slide plate are connected by a rod which extends through said spring housing with its end remote from said slide plate being supported on a portion of a release mechanism.

13. The ski binding according to claim 12, wherein said remote end of said rod has a hook thereon, said hook engaging a spring loaded locking lever.

* * * * *